US007186132B2

(12) United States Patent
Quintanilla

(10) Patent No.: US 7,186,132 B2
(45) Date of Patent: Mar. 6, 2007

(54) ELECTRICAL AND ELECTRONIC CONNECTOR WITH BLADE CLOSED BY LEVER

(76) Inventor: Raul Quintanilla, 817 Hollyridge Dr., Ballwin, MO (US) 63011

( * ) Notice: Subject to any disclaimer, the term of this patent is extended or adjusted under 35 U.S.C. 154(b) by 0 days.

(21) Appl. No.: 11/375,986

(22) Filed: Mar. 15, 2006

(65) Prior Publication Data

US 2006/0270269 A1 Nov. 30, 2006

Related U.S. Application Data

(60) Provisional application No. 60/686,082, filed on May 31, 2005.

(51) Int. Cl.
*H01R 4/24* (2006.01)

(52) U.S. Cl. ..... 439/417; 439/409

(58) Field of Classification Search ..... 439/409, 439/410, 417

See application file for complete search history.

(56) References Cited

U.S. PATENT DOCUMENTS

| | | | | |
|---|---|---|---|---|
| 4,326,767 A | | 4/1982 | Silbernagel | |
| 4,444,448 A | | 4/1984 | Silbernagel | |
| 4,645,285 A | | 2/1987 | Cozzens | |
| 4,679,881 A | | 7/1987 | Galvin | |
| 4,725,247 A | | 2/1988 | Fremgen | |
| 4,813,883 A | | 3/1989 | Staley | |
| 4,820,191 A | * | 4/1989 | Lacroix | 439/402 |
| 4,891,018 A | * | 1/1990 | Afflerbaugh et al. | 439/402 |
| 4,995,830 A | | 2/1991 | Eckhaus | |
| 5,626,489 A | | 5/1997 | Marshall | |
| 5,675,890 A | | 10/1997 | Yamamoto | |
| 6,080,006 A | * | 6/2000 | Broder | 439/409 |
| 6,139,353 A | * | 10/2000 | Muz | 439/417 |
| 6,261,117 B1 | * | 7/2001 | LaCroix | 439/393 |
| 6,305,967 B1 | | 10/2001 | Smith | |
| 2004/0259410 A1 | * | 12/2004 | Jaschke et al. | 439/409 |

* cited by examiner

*Primary Examiner*—Tho D. Ta
(74) *Attorney, Agent, or Firm*—Charles McCloskey

(57) ABSTRACT

The electrical connector has a housing with blades and multiple holes extending into the housing. A blade passes vertically through a snug slot in the housing and has holes with a keyhole shape. A first lever extends from a living hinge of the top of the housing and has a lock that secures the first lever when closed. In an alternate embodiment, the present invention has a second blade and slot, and a second lever hinged opposite and above the first lever that closes upon the first lever. In use, a worker grasps the connector and inserts insulated wires into the holes. Then the worker uses a thumb and forefinger to close the first lever which pushes the blade where the keyholes cut through insulation on the wires to make an electrical connection. The holes, openings, and slots have a waterproofing agent or silicone gel to seal the wires.

19 Claims, 7 Drawing Sheets

ELECTRICAL AND ELECTRONIC CONNECTOR WITH BLADE CLOSED BY LEVER

CROSS REFERENCE TO RELATED APPLICATION

This non-provisional patent application claims priority to the provisional patent application 60/686,082 which was filed on May 31, 2005 and is commonly owned by the same inventor.

BACKGROUND OF THE INVENTION

The present invention relates to connecting electrical wires in various circuits. The electrical connector with blade closed by lever has particular utility in a waterproof connection of multiple wires, made without hand tools.

Around and within lawns and landscapes in residential and commercial settings, owners have various devices placed. Owners seek lighting to highlight a lawn and to illuminate paths. Lighting and other systems also provide security. Owners also have irrigation for lawns and landscapes as needed by climate. Lighting, security, and irrigation systems operate with electrical circuits and wiring. Used in landscaping, wires must have a waterproof connection to minimize short circuits due to weather and groundwater. Short circuits prompt a repair call and the costs to owners for those calls can be significant.

When installing a lighting, security, or irrigation system, planners often divide an area into zones and each zone has an allotment of devices such as lights, sprinklers, or sensors. The devices within a zone are connected and then the zones are connected and linked to a control box for direct or indirect operation. Generally the devices and the zones connect in parallel circuits and often multiple wires come together in a connection with a main wire. The main wire provides electrical power or control signals to devices or a zone of devices.

Presently, wires are connected in parallel by a labor and tool intensive process. Each of the wires is stripped upon an end by a wire stripper tool held by an electrician. The bare ends are then placed into a twist-on wire connector with a main wire. The twist-on wire connector is then turned by hand and the wires joined within the twist-on wire connector. The electrician then checks that the wires are safely within the twist-on wire connector. Then the electrician packs the twist-on wire connector with a waterproofing compound or cover. For larger wire connections, each wire is brought into a junction box and then connected to other wires by a bus bar inside of the junction box. The junction box may be waterproof itself or can be waterproofed by a compound or cover. Then the twist-on wire connector or junction boxes are hidden in the landscape often by burying. Preparing the wire ends, connecting the ends, and waterproofing the connection call for labor and skill intensive work. Various connectors have been developed for outdoor and indoor use.

DESCRIPTION OF THE PRIOR ART

The use of connectors to join wires is known in the prior art. Connectors start simply as knots, splices, and tape, then advance to twist-on wire connectors and on to bolted connections, all of various complexities. As described above, twist-on wire connectors and junction boxes predominate in connecting multiple wires for landscaping, horticultural and other uses. The prior art shows a few connector devices for two or more wires.

For example, the patent to Silbernagel et al., U.S. Pat. No. 4,326,767, shows a wire cutting two piece connector for electrical wires. This connector receives multiple wires for electrical connection. Unlike the present invention, this connector has two pieces and a fixed blade that severs at least one wire inserted within the body and beneath the cover. The U shaped member and wire severing differentiate this connector from the present invention.

The patent to Markwardt, U.S. Pat. No. 4,444,447, shows an improved wire cutter. This patent has a boxlike body that receives multiple wires and a lid to close the body though separate from the body, a U shaped member that cuts and relieves the strain on wires, and metals of different hardness connected with the U shaped member. This patent with different metals and box construction differs from the present invention.

The other patent to Silbernagel et al., U.S. Pat. No. 4,444,448, shows a wire cutting two piece connector of electrical wires. Silbernagel's '448 patent descends from the '767 patent and as in the present invention, this patent has a body that receives wires and a hinged door upon one edge. However, this patent severs wires with the U shaped blade and the door covers the ends of the wires exposed following cutting. The U shape appears when viewing an edge of the blade. Further, the present invention, unlike the '448 patent, uses a lever to close itself without the use of a tool.

The patent to Cozzens et al., U.S. Pat. No. 4,645,285, has a two piece nested housing with internal foam. Like the present invention, this patent has a slotted terminal to electrically connect wires upon a circuit board. Unlike the present invention, this patent has foam within a housing, a circuit board mounting, and one wire per terminal. This patent advances the wire to the terminal where the present invention advances a blade to the wires.

Then the patent to Galvin et al., U.S. Pat. No. 4,679,881, has a hinged two piece housing with a knife blade. Like the present invention, this patent has a similar purpose for rapid installation without tools using unskilled labor. This patent has a cover in a hinged connection to a wall. Unlike the present invention, this patent accepts wire loops through slots, severs the wire loops for a series electrical connection, and leaves the slots open. The knife blade, pushing of wire, and open slots of this patent differentiates it from the present invention.

The patent to Fremgen, U.S. Pat. No. 4,725,247, has a device to splice cables without interruption. Similar to the present invention, this patent has channels to receive wires, an electrically conductive clamping member, and a cover that applies mechanical force to complete the splice. In contrast to the present invention, this patent has a separate cover and a separate carrier with knife blades.

The patent to Staley, U.S. Pat. No. 4,813,883, has an arrowhead wedge that contacts wires and fastens to a housing. As in the present invention, the patented device has a thin triangular shaped metal wedge that advances through the housing into wires. However, the patented device has a wedge with various edge treatments, two piece assembly, and calls for a hammer to set the wedge. These features make this fastening device different from the present invention.

The patent to Eckhaus, U.S. Pat. No. 4,995,830, shows a coupler that connects two or more wires. Like the present invention, the patented coupler receives insulated wire then slices through the wire to make electrical contact. Unlike the present invention, the patent shows the wires further connected to male and female pins and has U shaped slicing notches and an adjustable slicing mechanism for various gauges of wire but does not show a blade abutting the ends of multiple wires. Being a two part coupler, this patent differs from the present invention.

The patent to Marhsall et al., U.S. Pat. No. 5,626,489, illustrates a sealed electrical connector for wet areas. This patent has two portions forming a single piece, a plate like contact element, and channels that receive wires. But different from the present invention, this patent lacks a mechanical force, or tool to advance the plate upon wires and the plug into the seal, and has channels in the sealing portion.

Then the patent to Yamamoto et al., U.S. Pat. No. 5,675,890, describes a method using a connector housing that severs wire ends. This patent shares some operational steps with the present invention as a method patent, though this patent does not describe a device. This patent calls for placing wires into a receiving section where another portion cuts the insulation to establish an electrical connection. But unlike the present invention, this patented method cuts off waste ends of wire. The emphasis on method and cutting wire ends separate this patent from the present invention.

And, the patent to Smith, L., U.S. Pat. No. 6,305,967, illustrates a device to penetrate insulation to connect wires. This patented connector shares, with your invention, insulation piercing and lack of tools to operate the connector, as shown by cams. In contrast, this patent connects only two wires, uses cam action to advance the wire into the connector and to bend a terminal to pierce insulation. The use of cams to connect only two wires separates this patent from the present invention.

Connectors with housings, U shaped wire cutters, and offset blades have seen use in security, irrigation, and landscape designs across the country in various climates. The connectors join at least two wires, often only two and usually require a tool, such as lineman's pliers, to close the connector. While the above-described devices fulfill their respective, particular objectives and requirements, the aforementioned patents do not describe a connector with a blade closed by a lever and the blade having shaped holes to receive insulated wire.

Therefore, a need exists for a new and improved electrical connector that can be used for joining multiple wires in a waterproof connection without using tools. In this regard, the present invention substantially fulfills this need. Further, the electrical connector substantially departs from the conventional concepts and designs of the prior art, and in doing so provides a device primarily developed for the purpose of using a sliding blade with multiple holes to join multiple wires, typically closing the blade by hand in cooperation with a lever.

The present invention overcomes the difficulty of joining multiple insulated wires without tools. The present invention also allows a waterproof connection for outdoor and buried installations of the present invention.

SUMMARY OF THE INVENTION

In view of the foregoing disadvantages inherent in the known types of connectors now present in the prior art, the present invention provides an improved electrical and electronic connector, and overcomes the above-mentioned disadvantages and drawbacks of the prior art. As such, the general purpose of the present invention, which will be described subsequently in greater detail, is to provide a new and improved electrical connector which has all the advantages of the prior art mentioned heretofore and many novel features that result in a electrical connector which is not anticipated, rendered obvious, suggested, or even implied by the prior art, either alone or in any combination thereof.

To attain this, the present invention essentially comprises an housing with at least one blade within the housing. The present invention, a connector, has an housing with at least two holes upon one face that extend partially into the thickness of the housing but not through completely. Then a thin blade passes vertically through a snug slot in the housing. The blade has at least two holes with a keyhole shape. A first lever extends from a living hinge at a lateral edge of the top of the housing. Along the top face, the housing has a keyway or lock that secures the first lever when in the closed position. The first lever, living hinge, keyway, and lock are integral with the housing.

To use the present invention, a worker grasps the connector in one hand and inserts insulated wires into the holes. With the holes occupied, the worker uses the thumb and forefinger of the other hand to close the first lever. The first lever pushes the blade into the housing and the latch engages the first lever, sealing the housing. The keyholes in the blade cut through insulation on the wires to make an electrical connection. The holes, openings, and slots have a waterproofing agent, such as silicone gel among other substances, to seal the wires as they advance through the holes.

There has thus been outlined, rather broadly, the more important features of the invention in order that the detailed description thereof that follows may be better understood and in order that the present contribution to the art may be better appreciated.

The electrical connector may also include a fixed blade flush with the housing and additional blades extending above the housing, and the blade may be round, triangular, or other shape.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and devices for carrying out the several purposes of the present invention. It is important, therefore, that the claims be regarded as including such equivalent constructions insofar as they do not depart from the spirit and the scope of the present invention.

It is therefore an object of the present invention to provide a new and improved electrical connector that has all of the advantages of the prior art and none of the disadvantages.

It is another object of the present invention to provide an electrical connector that may be easily and efficiently manufactured and marketed.

It is still another object of the present invention to provide an electrical connector that may readily form waterproof connections of wires for use in horticulture, agriculture, lighting, and security for outdoor or buried installation.

It is still another object of the present invention to provide an electrical connector that may readily join multiple wires without hand tools.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
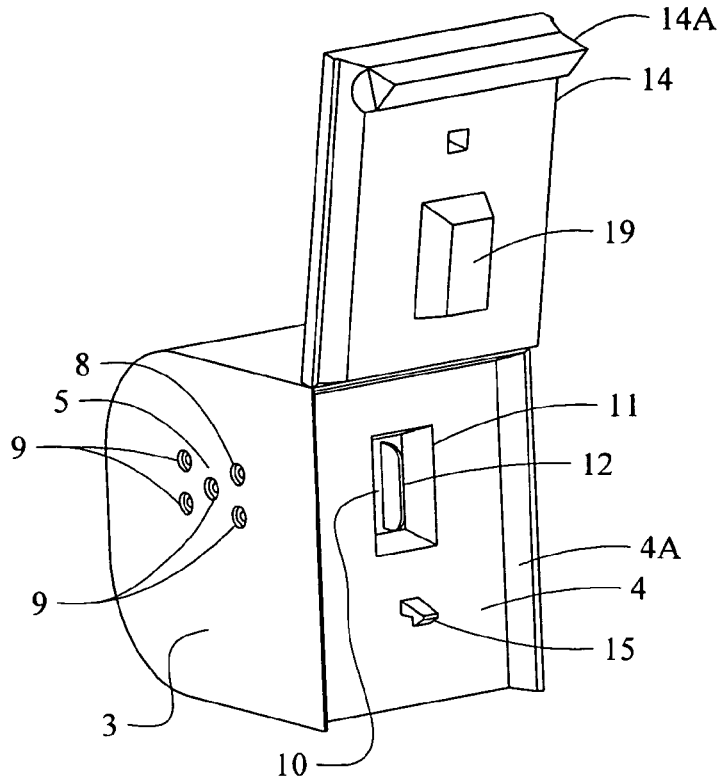
FIG. 1 is an isometric view with the single blade embodiment of the present invention open in accordance with the principles of the present invention.

The present art overcomes the prior art limitations by providing a connector that joins wires manually and without tools in a waterproof connection suitable for rugged outdoor use. Wires having insulation are placed into the connector and then connected with electrical continuity without stripping the ends of the wires. And so, in FIG. 1, the present invention 1 begins as a single blade embodiment with a housing 2 that has a generally rectangular form. The housing has a top face 4 and a front face 3 both rectangular and perpendicular to an edge of the top face.

The front face shares a common edge with the top face and accepts wires. Upon the housing, the front face has a pattern 5 of holes and an input hole 8 that admits a main wire to which other wires will connect in a parallel connection. To the side and beneath the input hole 8, the front face has at least one output hole 9 in a generally tight pattern. The output holes 9 admit additional wires for an electrical connection with the main wire. The input hole 8 and output holes 9 are cylindrical and packed with a waterproofing agent, such as semisolid silicone among other substances. Then the input hole and output holes extend partially into the housing and have a countersink at the front face to retain additional waterproofing agent.

The top face 4 is perpendicular to the front face and shares a common longitudinal edge. The present invention 1 has a safety 14A to prevent inadvertent closure of the invention and a means to lock 15 the first lever 14 upon the top face 4. In the preferred embodiment, the safety 14A extends across a lateral edge of the first lever opposite the living hinge. The safety itself has a living hinge connection. The safety has a generally triangular cross section that requires a user to grasp an edge of the safety knowingly to release the first lever 14 for closure. Flanking each end of the safety, the first lever has indentations therein to admit the fingertips of a user when moving the safety. Then the locking means 15 includes a key way 4*a* extending upwards from the top face adjacent to the front face and the rear face. The first lever has a width narrower than the top face so the first lever fits within the key way 4*a*. The locking means also includes a two part locking mechanism. Upon the top face generally away from the pattern of holes 5, the top face has the male component of a lock shown as a tooth 15. The tooth extends upward from the top face upon the lateral edge opposite the living hinge. Then the first lever then receives the tooth in a corresponding hole where a lip of the tooth prevents the first lever from re-opening.

In the single blade embodiment away from the hinged connection of the first lever to the housing, the top face has an opening 10 generally rectangular in shape and that extends partially into the housing 2 towards the pattern of holes 5. The opening 10 has a centered slot 11 of a thin width parallel to the length of the top face while the length of the opening is parallel to the length of the housing. The opening and slot both have waterproofing agent within, such as silicone. A blade 12 slides within the opening and the slot and communicates with the input hole 8, and output holes 9.

Figure 1A:
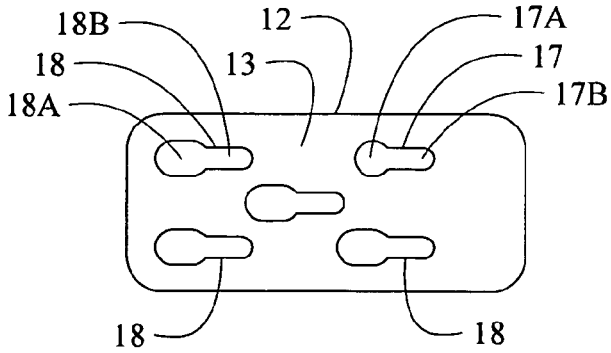
FIG. 1A is a detailed view of the blade of the single embodiment.

The blade, shown in FIG. 1A, has a generally rectangular shape with rounded corners and a length less than the height of the housing. Preferably the blade is made of brass and generally has a pattern 13 of holes. In particular, the blade has a first keyhole 17 with a rounded end 17*a* and a narrow slot 17*b* extending from the rounded end 17*a* toward the first lever 14 when installed in the slot 11 and parallel to the length of the blade 12. The first keyhole 17 corresponds to the input hole 8. Flanking and beneath the first keyhole, a plurality of second keyholes 18 correspond to the output holes 9. The second keyholes 18 have a rounded elongated end 18*a* and then an elongated slot 18*b* parallel to the length of the blade. Both the first and the second keyholes are aligned in the same direction.

Upon the lateral edge where the first lever joins the housing, the top face has a hinged connection to a first lever 14. The hinge is preferably a living hinge however strap hinges are an alternate embodiment of the connection. The first lever 14 has a generally rectangular shape similar to that of the top face but of slightly lesser width to fit within the keyway. Away from the hinge, the first lever has a tenon or button 19 extending beneath the lever and having the same planar shape as the opening 10. The button 19 has a height commensurate with the depth of the opening 10.

Figure 1B:
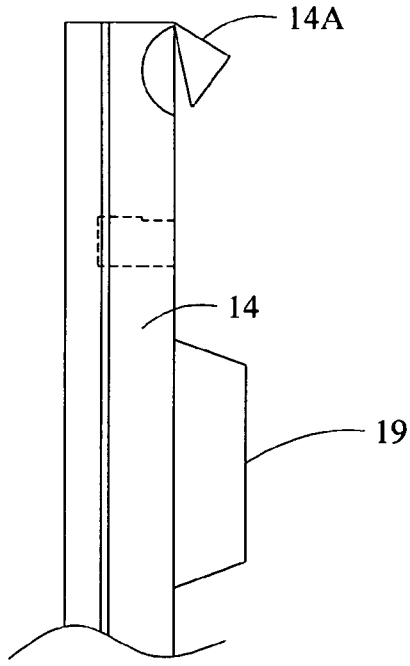
FIG. 1B is a side view of the safety of the present invention.

Returning to the safety 14A, FIG. 1B shows a side view of the safety when in the open position. The safety has two positions, open and closed. The closed position rotates the safety axially onto the first lever. In the closed position, the safety makes the first lever stand off from the keyway 4A so the button 19 does not advance the blade 12. After a user connects wires to the blade through the holes, the user grasps the safety from the ends using the indentations or the longitudinal edge of the safety. The user then rotates the safety 14A away from the button and then closes the first lever upon the top face, thus advancing the blade to connect the wires within the holes for conducting electrical charge.

Figure 2:
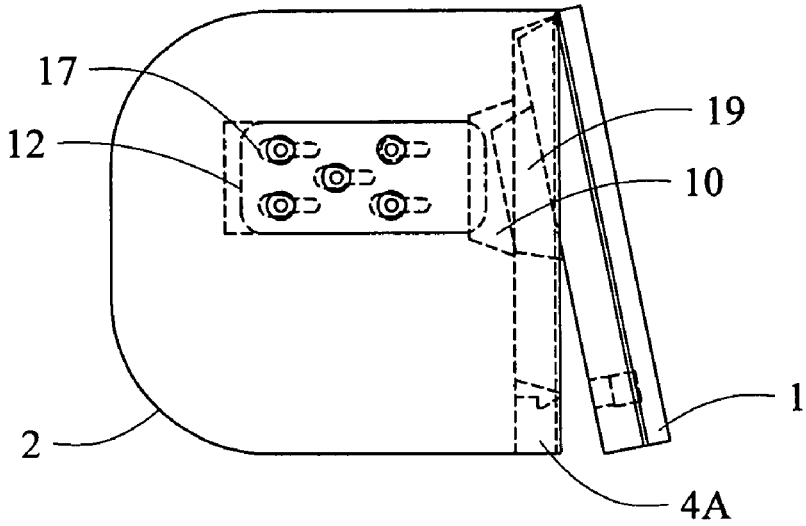
FIG. 2 is a side view of the single blade embodiment of the present invention with the lever up.

FIG. 2 has the housing 2 prepared to close for connection of wires. A main wire is placed into the input hole and additional wires are placed into the output holes, up to the number of output holes. The main wire and additional wires are pushed through their holes and into the first and second keyholes of the blade. Then the first lever 14 is closed towards the housing 2 so that the button 19 approaches the opening 10. When the button 19 rests upon the blade 12, a user inspects the wires and the housing for a tight connection. Once inspection is passed, the user closes the first lever upon the top face.

Figure 3:
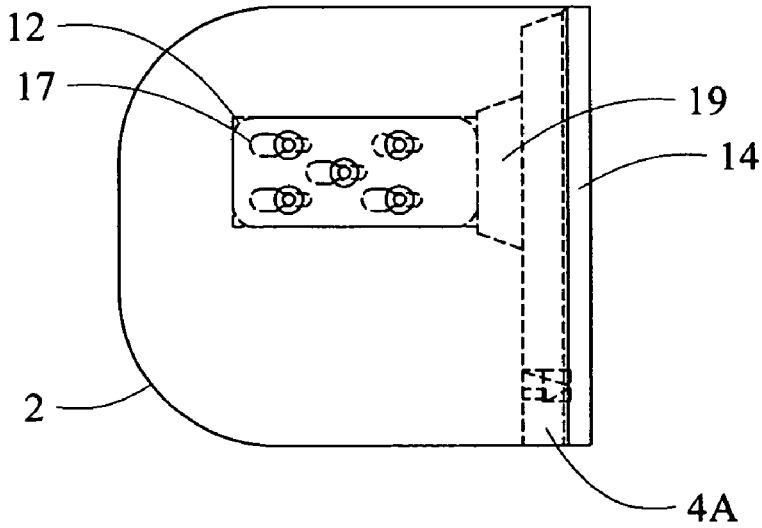
FIG. 3 shows the lever closed upon the single blade embodiment of the present invention.

In doing so, the user advances the first lever within the flanks of the key way 4*a* forming a flush top of the invention with the first lever closed as described in FIG. 3. Simultaneously, the button 19 presses upon the top edge of the blade 12 and advances the blade through the slot and further down into the housing. As the blade advances, the first keyhole 17 cuts the insulation of the main wire as the wire enters the narrow elongated slot. The first keyhole 17 then establishes electrical continuity between the main wire and the blade. Further advancing of the blade, the second keyholes then cut the insulation of the additional wires when the narrow elongated slots 18*b* permit passage of the gage of wire but not the insulation. When the blade comes to rest and the first lever locks, electrical continuity exists from the main wire through the blade 12 to the additional wires. The waterproofing agent or silicone that remains in the input and output holes maintains the wires in a waterproof connection. As described, the main wire and additional wires are inserted manually and the first lever is closed manually thus calling for less skilled labor and reducing labor costs.

Figure 4:
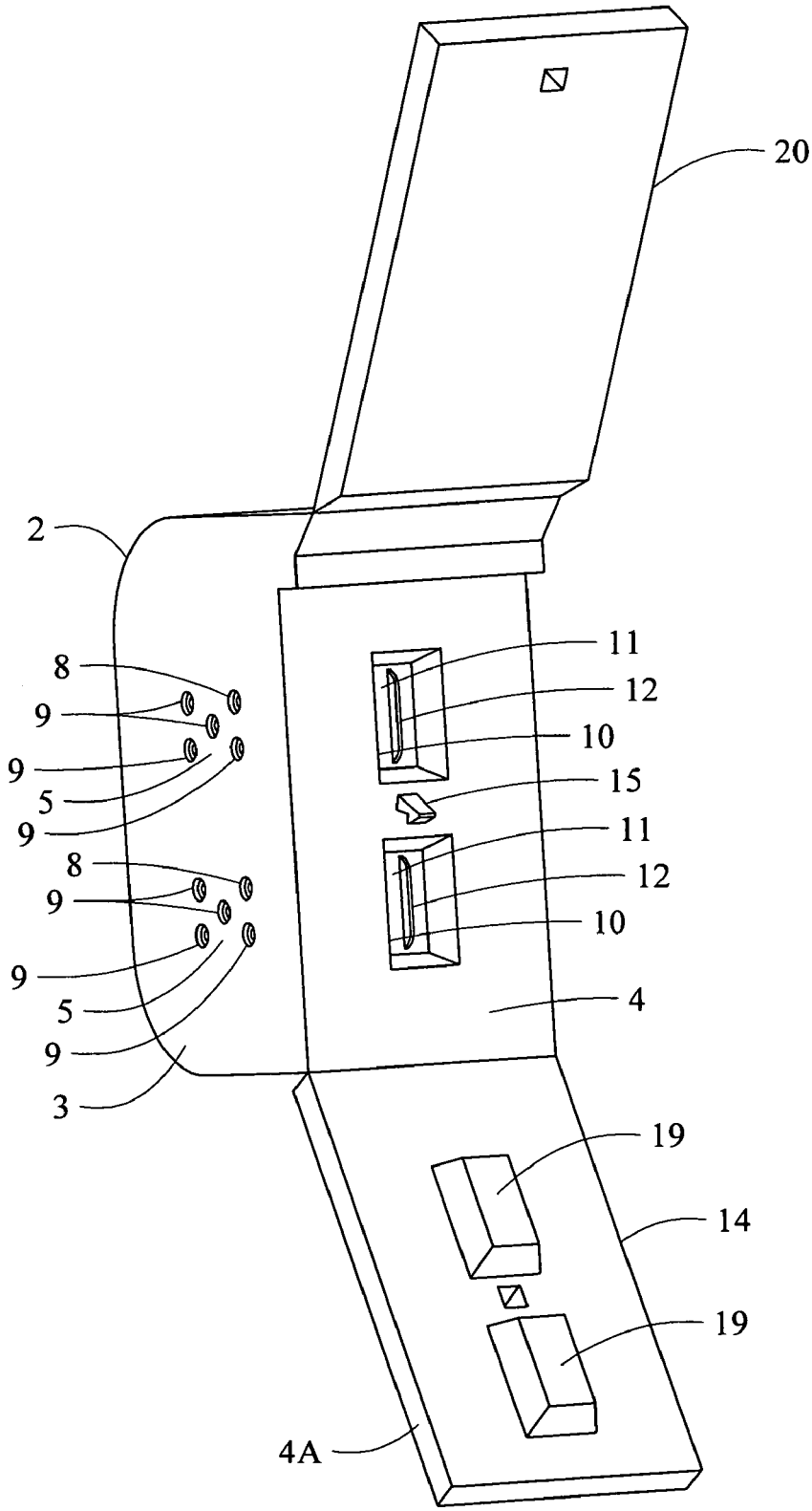
FIG. 4 describes an isometric with the double blade embodiment of the present invention open.

Similar to FIG. 1, FIG. 4 shows a double blade embodiment of the present invention with a housing 2 that has a generally rectangular form. The housing has a top face 4 and a front face 3 both being rectangular and perpendicular to an edge of the top face.

The front face shares a common edge with the top face and accepts wires. Upon the housing, the front face 3 has two patterns of holes including an input hole 8 that admits a main wire to which other wires will connect in a parallel connection. To the side and beneath each input hole, the front face has at least one output hole 9 in a generally tight pattern. The output holes admit additional wires for an electrical connection with the main wire. The input hole 8 and output holes 9 are cylindrical and packed with semisolid silicone, among other substances, as a waterproofing agent. Then the input hole and output holes extend partially into the housing. To aid in description, the double blade embodiment has more holes in the front face than the single embodiment but additional holes take on a familiar arrangement.

The top face is perpendicular to the front face and shares a common longitudinal edge. Upon a lateral edge of the top face, the top face has a hinged connection to a first lever 14. The hinge is preferably a living hinge however strap hinges are an alternate embodiment of the connection. The first lever has a generally rectangular shape of a length slightly less than that of the top face. Away from the hinge, the first lever has two tenons or buttons 19 extending beneath the first lever. Opposite the first lever when closed, the top face has two openings 10 generally rectangular in shape and that extend partially into the housing towards the respective patterns 5 of holes. Each opening has a centered slot 11 of a thin width and parallel to the length of the top face. The length of each slot 11 extends along the length of the housing. The openings and slots are filled with a waterproofing agent such as silicone. The buttons 19 have the same planar shape as the openings 10 and a height commensurate with the depth of the openings. Upon the opposite lateral edge of the top face, that is opposite the hinge of the first lever and above the first lever, the top face has the second lever 20. The second lever 20 has a living hinge connection to the lateral edge or alternatively a strap hinge. The second lever has a generally rectangular shape of a length similar to that of the top face but of a narrower width.

Generally the second lever 20 overlays the first lever 14 within the key ways 4*a* and assists in closing the first lever upon the openings. Once the first and second levers are closed it is desirable to keep them closed. In the preferred double blade embodiment, the first lever 14 has a keyway 4*a* upon the face opposite the buttons. The key way has two spaced apart sides extending generally for the length of the first lever. The spacing between the sides admits the second lever that closes upon the first lever. The top face also has a lock shown as a tooth 15 generally centered between the two openings 10. The tooth extends a lip into a hole in the underside of the first lever 14 generally centered between the buttons 19. In an alternate embodiment as later shown in FIGS. 7–9, a two part locking means begins away from the hinged connection toward the lateral edge where the second lever receives a male component of the lock or tooth 21 from the first lever 14. The tooth extends upward from the first lever opposite the buttons 19 and is generally located proximate to the hinged connection of the first lever 14. Closing the second lever 20 upon the first lever 14 advances the tooth upon the second lever as it closes upon the first lever, thus, preventing reopening of the invention.

Figure 4A:
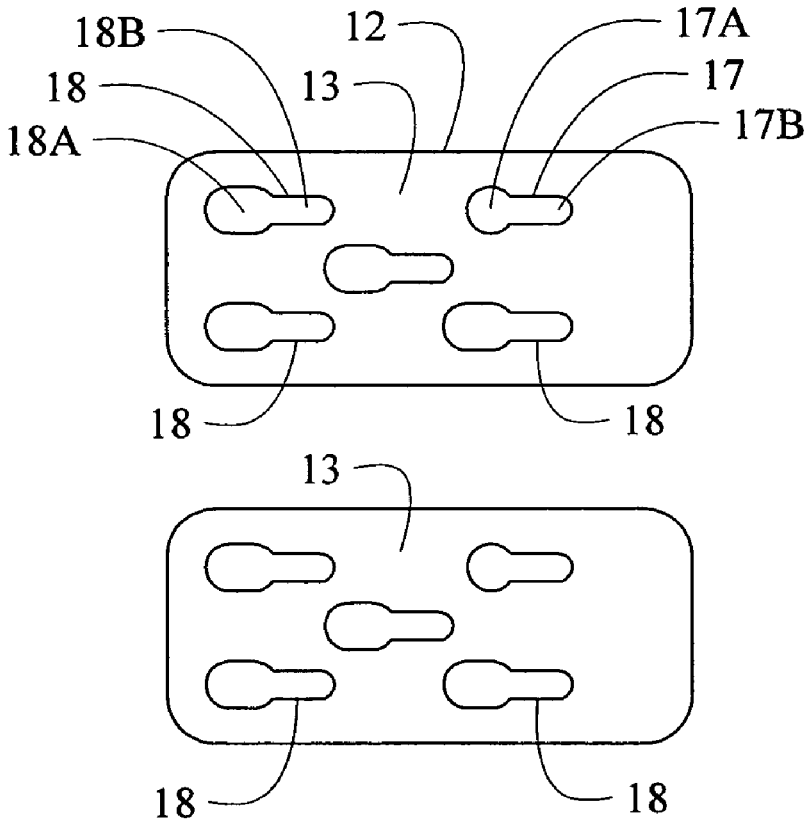
FIG. 4A is a detailed view of the blade of the double embodiment.

A blade 12 slides within each opening 10 and slot 11, and communicates with the input hole 8, and output holes 9 upon the front face in the double blade embodiment where one pattern 5 of input hole and of output holes handles a positive electrical connection and the other pattern 5 of input hole and output holes handles a negative electrical connection. The blades 12, shown in FIG. 4A, have a generally rectangular shape with rounded corners and a length less than the height of the housing. Preferably each blade is made of brass and generally has a pattern 5 of holes. Each blade has a first keyhole 17 with a rounded end 17*a* and a narrow slot 17*b* extending from the rounded end towards the top face and parallel to the length of the blade. The first keyhole corresponds to the input hole 8. Flanking and beneath the first keyhole, a plurality of second keyholes 18 correspond to the output holes 9. The second keyholes have a rounded elongated end and then an elongated slot parallel to the length of the blade. Both the first and the second keyholes are oriented in the same direction.

Figure 5:
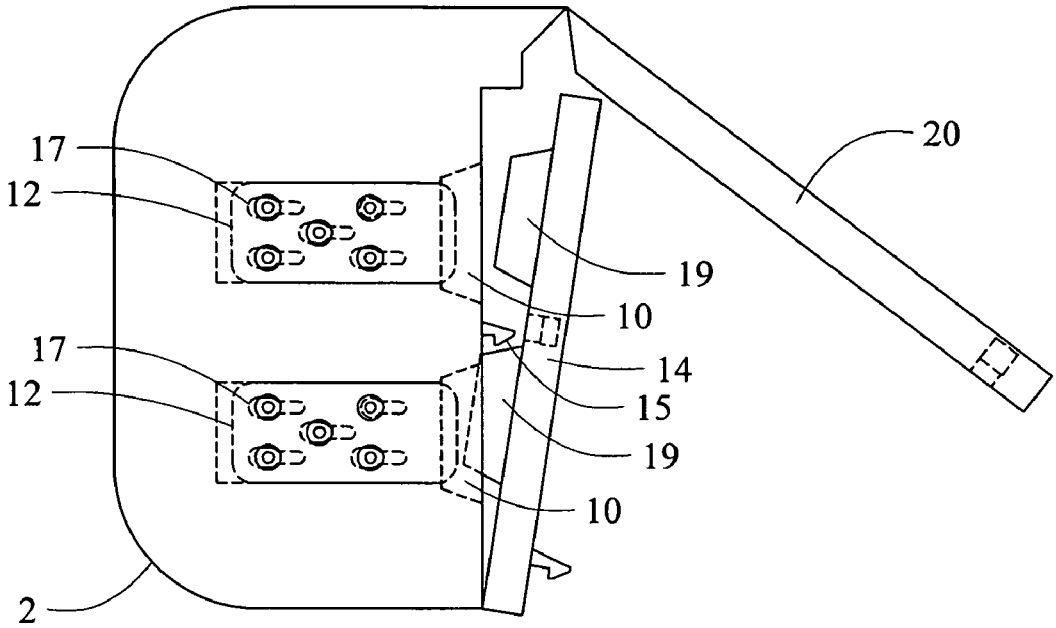
FIG. 5 illustrates a side view with the first and second levers up in the double blade embodiment of the present invention.

FIG. 5 has the housing 2 of the double blade embodiment prepared to close for connection of wires with the blades 12 as ready to accept wires. Main wires are placed into the input holes 8 and additional wires are placed into the output holes 9, up to the number of output holes. The main wires and additional wires are pushed through their respective holes and into the first and second keyholes of each blade 12. Then the first lever 14 is closed towards the housing 2 so that the buttons 19 approach the openings 10. The first lever approaches a tooth 15 generally centered between the openings 10 and the tooth engages a cooperating hole in the underside of the first lever. When the buttons 19 rest upon the blades 12, a user inspects the wires and the housing for a tight connection. Once inspection is passed, the user places the first lever 14 upon the top face 4 where the tooth secures into the hole. The tooth serves as a locking mechanism between the first lever and the top face. As the double embodiment anticipates more wires, the user then closes the second lever 20 upon the top of the first lever 14 within the key way 4*a*. The compound lever action assists in closing the first and second levers upon the housing, while cutting the insulation upon numerous wires.

Figure 6:
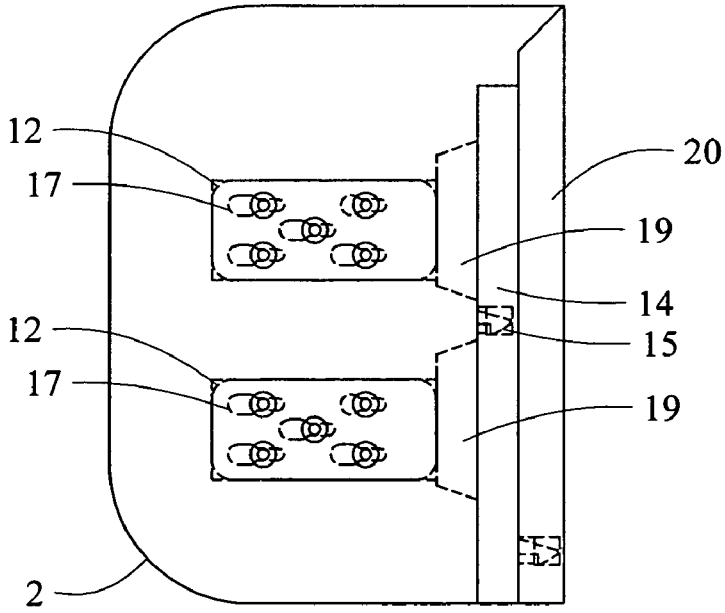
FIG. 6 shows both of the levers closed upon the double blade embodiment of the present invention.

In doing so, the user simultaneously advances the buttons 19 upon the top edges of the blades 12 and advances the blades through the slots 11 and further down into the housing as described in FIG. 6. As the blades advance, the first keyhole cuts the insulation of the main wires as the wires enter the narrow elongated slot 17*b*. The first keyholes then establish electrical continuity between the input wires and the blades. As the blades are further advanced, the second keyholes 18 then cut the insulation of the additional wires when the narrow elongated slots permit passage of the gage of wire but not the insulation. In an alternate embodiment, each of the blades 12 has a specific pattern of keyholes 17, 18 that permit sequential and consecutive cutting of insulation to minimize the force required to be applied by hand.

When the blades come to rest and the first lever closes upon the top face, electrical continuity exists from the main wires through the blades to the additional wires. With the second lever 20 closed upon the first lever 14, the top face 4 of the housing 2 is sealed in two ways: mechanically as the buttons occupy the openings and physically as a waterproofing agent occupies the remaining void spaces where the buttons meet the blades. The waterproofing agent or silicone that remains in the input and output holes maintains the wires in a waterproof connection. As described, the main wires and additional wires are inserted manually and the first lever and second levers are closed manually thus calling for less skilled labor and reducing labor costs.

Figure 7:
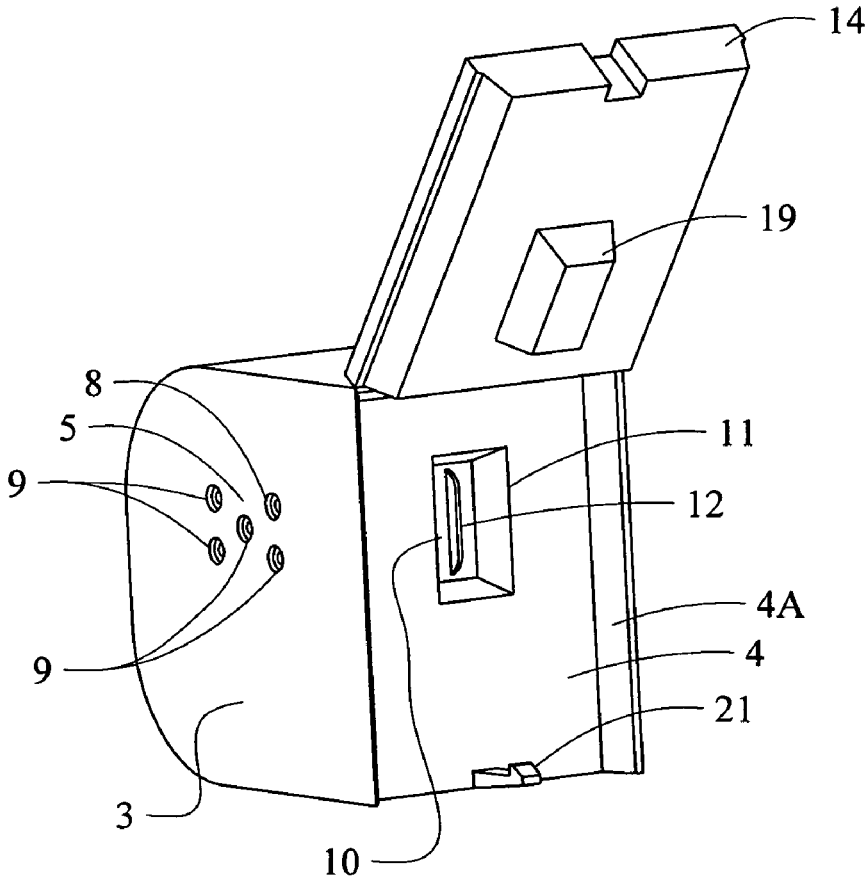
FIG. 7 shows the single blade embodiment with the first lever secured by a locking tooth; and, FIGS. 8 and 9 show the first lever closing upon the locking tooth and coming to rest within the keyway.

FIG. 7 shows a single blade embodiment with a locking means taking form as a tooth 21 that engages a corresponding notch in the first lever opposite the living hinge. The tooth and notch are generally centered and located at the edge of the housing and the first lever respectively. In use, a worker places wires into the input hole and the output holes then closes the first lever 14 towards the top face 4. The first lever fits within the keyway 4A and the tooth 21 fits within the corresponding notch, thus closing the first lever firmly the housing and preventing the first lever from releasing off the blade 12.

Figure 8:
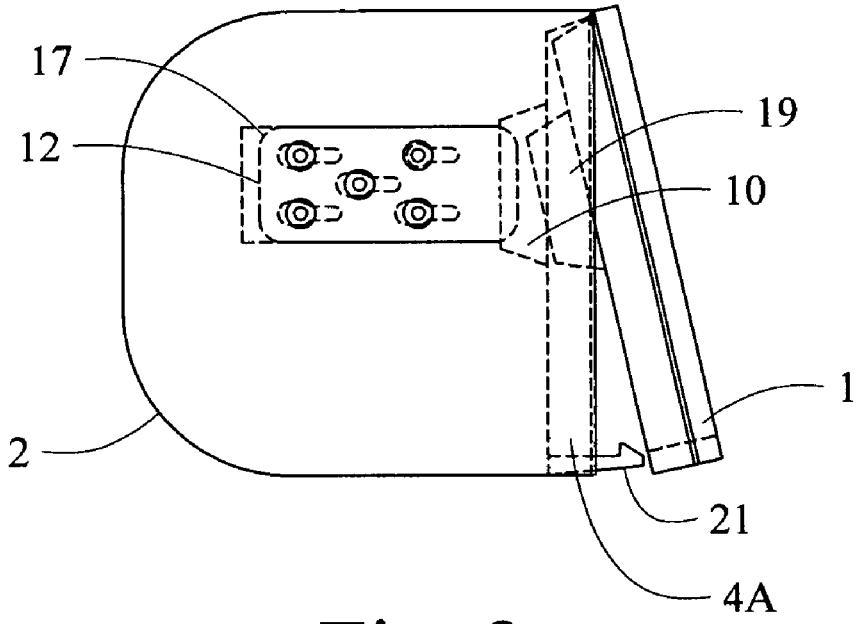
Figure 9:
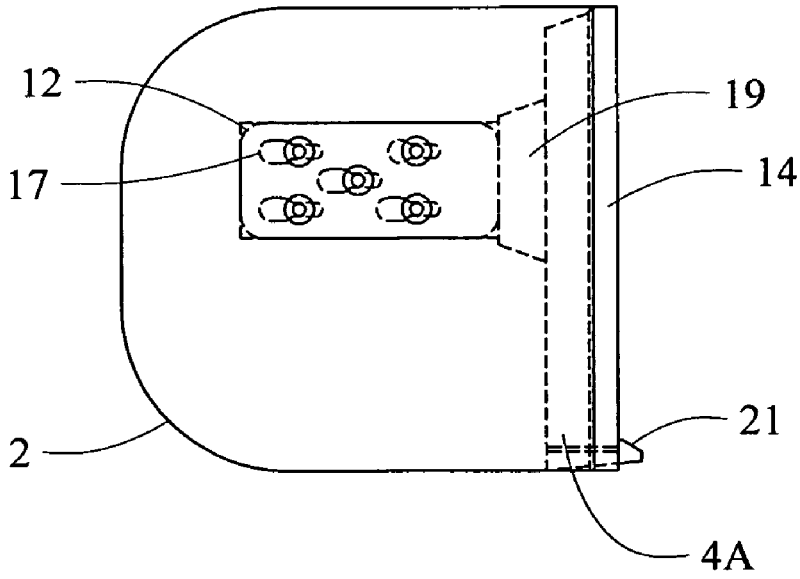

As the first lever closes upon the tooth, the button 19 presses upon the blade in FIG. 8. The first lever approaches the tooth 21 that extends above the keyway 4A. The tooth terminates in a lip, similar to a single faced arrowhead. The lip first engages the notch and deflects the tooth outwards so the first lever passes along the tooth. When the first lever reaches the top face 4 in FIG. 9, the tooth returns to its original position and the lip grasps the outermost surface of the first lever. The first lever has also advanced the blade 12 further into the housing, thus cutting the insulation of the wires, and completing an electrical connection from a single input wire to multiple output wires.

From the aforementioned description, an electrical and electronic connector with blade closed by lever has been described. The electrical connector is uniquely capable of manually joining multiple wires in a waterproof connection without tools. The electrical connector and its various components may be manufactured from many materials, including but not limited to polymers, polyvinyl chloride, high density polyethylene, polypropylene, nylon, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. An electrical connecting device for multiple wires closed by hand and waterproof, comprising:

a housing, having a front face and a generally perpendicular top face;

said front face including at least one pattern of holes having a waterproofing agent within said holes, said pattern including an input hole for a main wire, and a plurality of output holes for additional wires to attain electrical continuity with the main wire;

said top face having at least one opening, said opening containing a centered thin slot in communication with said holes;

at least one blade sliding within each of said openings, said blade having a plurality of holes corresponding to said pattern in said front face;

at least one lever hingedly connected to said housing, said lever closing said openings and having a safety and a means to lock said at least one lever closed upon said housing.

2. The electrical connecting device of claim 1 further comprising:

said lever having at least one button extending beneath said lever for seating within said openings and upon said blades.

3. The electrical connecting device of claim 1 further comprising:

said safety, hingedly connected to said lever opposite the connection of said lever to said housing, said safety rotating lengthwise away from said lever permitting closure of said lever upon said top face.

4. The electrical connecting device of claim 1 further comprising:

said holes having a shape to admit wires;

said plurality of holes in each of said blades having a first keyhole, and a plurality of second keyholes wherein said first keyhole and said second keyholes are arranged mutually parallel, and aligned towards said lever.

5. The electrical connecting device of claim 4 wherein said first keyhole has a rounded end and then an elongated end of lesser width than said rounded end and, said second keyhole has an elongated rounded end and then an elongated end of lesser width than said elongated round end.

6. The electrical connecting device of claim 3 further comprising:

said front face having two patterns of holes;

said top face having two of said openings;

two of said blades; and, said levers having a first lever and a second lever, said first lever hingedly connecting to said top face, said second lever hingedly connecting opposite said first lever and closing upon said first lever.

7. The electrical connecting device of claim 6 further comprising:

said locking means having a keyway upon said first lever and said second lever having a narrower width than said first lever to fit within said keyway.

8. The electrical connecting device of claim 6 further comprising:

said locking means having a male component upon said top face that grasps said first lever and upon said first lever that grasps said second lever.

9. The electrical connecting device of claim 5 further comprising:

said front face having one pattern of holes;

said top face having one of said openings;

one blade; and, said lever hingedly connecting to said top face.

10. The electrical connecting device of claim 9 further comprising:

said locking means having a keyway upon said top face and said lever having a narrower width than said top face to fit within said keyway.

11. The electrical connecting device of claim 10 further comprising:

said locking means having a male component upon said top face that grasps said lever.

12. An electrical connecting device for multiple wires closed by hand and waterproof, comprising:

a housing, having a front face and a generally perpendicular top face;

said front face including at least one pattern of holes having a waterproofing agent within said holes, said pattern including an input hole for a main wire, and a plurality of output holes for additional wires to attain electrical continuity with the main wire;

said top face having at least one opening, said opening containing a centered thin slot in communication with said holes;

at least one blade sliding within each of said openings, said blade having a plurality of holes corresponding to said pattern in said front face;

at least one lever hingedly connected to said housing, said lever closing said openings and having a means to lock said levers closed upon said housing; and, said locking means locating upon said top face.

13. The electrical connecting device of claim 12 further comprising:

a safety, hingedly connecting to said lever opposite the connection of said lever to said housing and rotating lengthwise away from said lever permitting closure of said lever upon said top face.

14. The electrical connecting device of claim 12 further comprising:

said locking means having a keyway upon said top face and said lever having a narrower width than said top face to fit within said keyway.

15. The electrical connecting device of claim 12 further comprising:

said locking means having a male component centered upon said top face that grasps said lever.

16. The electrical connecting device of claim 12 further comprising:

said holes admitting wires;

said plurality of holes in each of said blades having a first keyhole, and a plurality of second keyholes wherein said first keyhole and said second keyholes are arranged mutually parallel, and aligned towards said lever;

said first keyhole having a rounded end and then an elongated end of lesser width than said rounded end and, said second keyhole has an elongated rounded end and then an elongated end of lesser width than said elongated round end.

17. The electrical connecting device of claim 16 further comprising:

said levers having a first lever and a second lever, said first lever hingedly joined to said housing; and, said second lever hingedly joined to said housing opposite and outwards from said first lever and having a length greater than said first lever.

18. The electrical connecting device of claim 17 further comprising:

said locking means having a keyway upon said first lever and said second lever having a narrower width than said first lever to fit within said keyway.

19. The electrical connecting device of claim 17 further comprising:

said locking means having a male component centered upon said first lever that grasps said second lever.

* * * * *